US010421272B2

(12) United States Patent
Ishida et al.

(10) Patent No.: US 10,421,272 B2
(45) Date of Patent: Sep. 24, 2019

(54) CONTROL METHOD OF LIQUID EJECTION HEAD AND LIQUID EJECTION APPARATUS

(71) Applicant: CANON KABUSHIKI KAISHA, Tokyo (JP)

(72) Inventors: Yuzuru Ishida, Yokohama (JP); Yoshinori Misumi, Tokyo (JP); Maki Kato, Fuchu (JP); Takeru Yasuda, Kawasaki (JP); Norihiro Yoshinari, Tokyo (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/020,244

(22) Filed: Jun. 27, 2018

(65) Prior Publication Data

US 2019/0023005 A1 Jan. 24, 2019

(30) Foreign Application Priority Data

Jul. 20, 2017 (JP) ..... 2017-141121

(51) Int. Cl.

*B41J 2/045* (2006.01)
*B41J 2/14* (2006.01)
*B41J 2/16* (2006.01)

(52) U.S. Cl.

CPC ..... *B41J 2/04541* (2013.01); *B41J 2/0458* (2013.01); *B41J 2/14072* (2013.01); *B41J 2/14129* (2013.01); *B41J 2/164* (2013.01)

(58) Field of Classification Search

CPC .. B41J 2/04541; B41J 2/0458; B41J 2/14072; B41J 2/14129; B41J 2/1603; B41J 2/164; B41J 2/1625; C25D 7/00

See application file for complete search history.

(56) References Cited

U.S. PATENT DOCUMENTS 9,498,956 B2 * 11/2016 Kato ..... B41J 2/0458

FOREIGN PATENT DOCUMENTS

JP 2014124920 A 7/2014

* cited by examiner

*Primary Examiner* — Thinh H Nguyen

(74) *Attorney, Agent, or Firm* — Canon U.S.A., Inc. IP Division

(57) ABSTRACT

A control method of a liquid ejection head, in which the liquid ejection head having first and second heat generating resistors that generate thermal energy for ejecting liquid, includes first covering portion covers the first heat generating resistor. A second covering portion is electrically connected to the first covering portion and covering the second heat generating resistor. An insulating layer is provided between the first heat generating resistor and the first covering portion and between the second heat generating resistor and the second covering portion. Surface potentials are set of the first and second covering portions to be equal to or less than a ground potential in a state where drive voltage is not applied to the first and second heat generating resistors, is accomplished in accordance with application of drive voltage to at least either the first heat generating resistor or the second heat generating resistor.

10 Claims, 5 Drawing Sheets

CONTROL METHOD OF LIQUID EJECTION HEAD AND LIQUID EJECTION APPARATUS

BACKGROUND OF THE INVENTION

Field of the Invention

The disclosure relates to a control method of a liquid ejection head that ejects liquid, and a liquid ejection apparatus that ejects liquid.

Description of the Related Art

A liquid ejection apparatus having a system for energizing a heat generating resistor and heating liquid inside a liquid chamber to cause film boiling in the liquid and ejecting liquid droplets from an ejection port by bubble generating energy generated at this time is currently adopted in many cases.

In such a liquid ejection apparatus, a physical action such as cavitation impact caused by bubble generation, shrinkage, and bubble dissipation in liquid in a region on the heat generating resistor may affect the region on the heat generating resistor. Since the heat generating resistor has high temperature when the liquid is ejected, a chemical action in which a component of the liquid is thermally decomposed and the resultant is bonded, fixed, and deposited onto a surface of the heat generating resistor may affect the region on the heat generating resistor. In order to protect the heat generating resistor from such a physical action or chemical action for the heat generating resistor, a covering portion that covers the heat generating resistor and is made of a metal material or the like is disposed on the heat generating resistor in some cases.

The covering portion is normally disposed at a position where the covering portion contacts liquid. Thus, when current flows through the covering portion, electrochemical reaction is caused between the covering portion and the liquid, and a function as the covering portion is impaired in some cases. Thus, an insulating layer is disposed between the heat generating resistor and the covering portion so that a part of electricity to be supplied to the heat generating resistor does not flow through the covering portion.

However, there is possibility that a function of the insulating layer is impaired due to a certain factor and electrical connection in which electricity flows directly to the covering portion from the heat generating resistor or a wire is caused. In a case where a part of the electricity to be supplied to the heat generating resistor flows through the covering portion, the electrochemical reaction is caused between the covering portion and the liquid and the covering portion is deteriorated in some cases. In a case where covering portions that cover a plurality of heat generating resistors are electrically connected to each other, there is possibility that current also flows through a covering portion different from the covering portion in which the electrical connection is caused and influence of the deterioration extends.

Then, Japanese Patent Laid-Open No. 2014-124920 describes a configuration in which a plurality of covering portions which are connected to each other through fuse units are electrically connected to a common wire. In such a configuration, when the electrical connection described above is caused and current flows through one covering portion, a fuse unit is cut by the current, thus breaking electrical connection with another covering portion. This makes it possible to suppress extending of influence of the deterioration of the covering portion. Japanese Patent Laid-Open No. 2014-124920 also describes that a thickness of the fuse unit is made thinner than those of the covering portions that cover the heat generating resistors and the common wire so that the fuse unit is easily cut.

However, even in a case where electrical connection between the heat generating resistor and the covering portion is caused, when a region where the heat generating resistor contacts the covering portion is minute, contact resistance is large and current flowing through the fuse unit is reduced, so that there is possibility that the fuse unit is not cut reliably.

Thus, even in the configuration in which the fuse unit is provided, current flows from the covering portion, in which electrical connection is caused because the fuse unit is not cut, to another covering portion and influence of the deterioration of the covering portion may extend in an entire head.

Accordingly, it would be advantageous to, when an electrical connection between a heat generating resistor and a covering portion is utilized in a liquid ejection head, further improve suppression techniques of deterioration of the covering portion with a control method and liquid ejection head and liquid ejection apparatus that has otherwise not been disclosed in the prior art.

SUMMARY OF THE INVENTION

A control method of a liquid ejection head of the invention, in which the liquid ejection head includes a first heat generating resistor and a second heat generating resistor that generate thermal energy for ejecting liquid through application of a drive voltage; a first covering portion that covers the first heat generating resistor; a second covering portion that is electrically connected to the first covering portion and covers the second heat generating resistor; and an insulating layer that is provided between the first heat generating resistor and the first covering portion and between the second heat generating resistor and the second covering portion, includes setting surface potentials of the first covering portion and the second covering portion to be equal to or less than a ground potential in a state where the drive voltage is not applied to the first heat generating resistor and the second heat generating resistor, in accordance with application of the drive voltage to at least either the first heat generating resistor or the second heat generating resistor.

Further features and aspects of the disclosure will become apparent from the following description of numerous embodiments with reference to the attached drawings.

BRIEF DESCRIPTION OF THE DRAWINGS

FIGS. 5A to 5F2 are views for explaining an example control method of the liquid ejection head and a time change of a surface potential of a covering portion.

DESCRIPTION OF THE EMBODIMENTS (Example Liquid Ejection Apparatus)

Figure 1A:
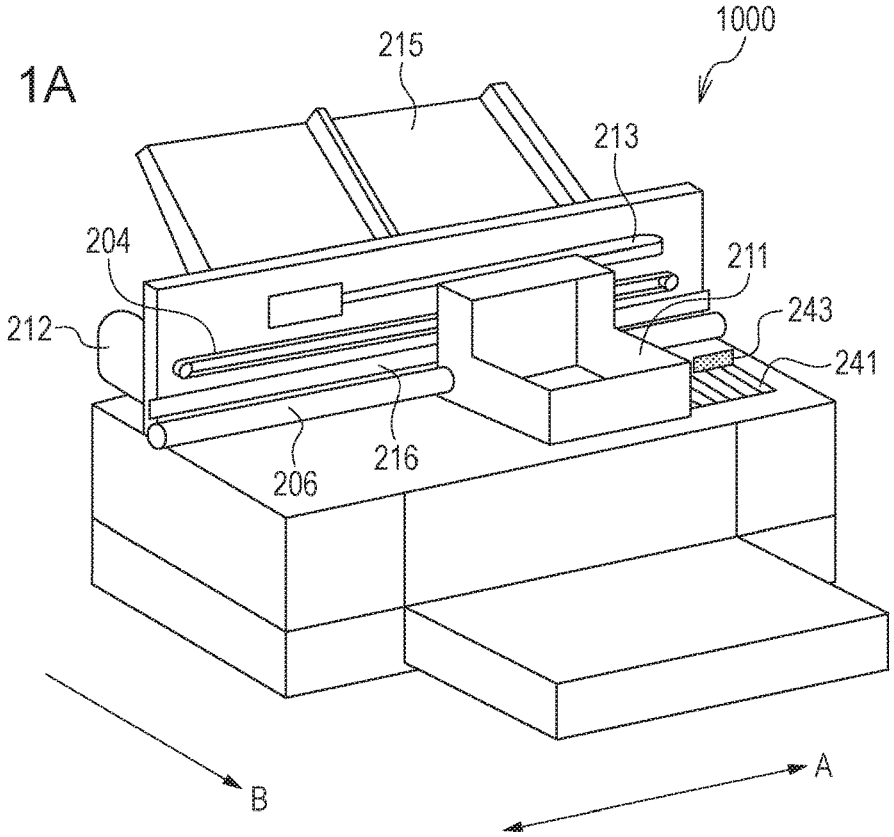
FIGS. 1A and 1B illustrate an example liquid ejection apparatus and an example liquid ejection head unit.

FIG. 1A is a perspective view illustrating a liquid ejection apparatus 1000 according to an embodiment of the invention. The liquid ejection apparatus 1000 includes a carriage 211 in which a liquid ejection head unit 410 is stored. In the liquid ejection apparatus 1000 of the present embodiment, the carriage 211 is guided so as to move freely in a main scanning direction of an arrow A along a guide shaft 206. The guide shaft 206 is disposed so as to extend along a width direction of a recording medium. Thus, a liquid ejection head mounted in the carriage 211 performs recording while performing scanning in a direction crossing a conveyance direction in which the recording medium is conveyed. In this manner, the liquid ejection apparatus 1000 is a so-called serial scanning type liquid ejection apparatus that records an image accompanied by movement of a liquid ejection head 1 in the main scanning direction and conveyance of the recording medium in a sub-scanning direction.

The carriage 211 is supported by the guide shaft 206, which penetrates therethrough, so as to be scanned in a direction orthogonal to the conveyance direction of the recording medium. A belt 204 is attached to the carriage 211, and a carriage motor 212 is attached to the belt 204. Thereby, a driving force by the carriage motor 212 is transmitted to the carriage 211 via the belt 204, and thus the carriage 211 is configured so as to be movable in the main scanning direction while being guided by the guide shaft 206.

A flexible cable 213 for transferring an electrical signal from a control unit to the liquid ejection head 1 of the liquid ejection head unit 410 is attached to the carriage 211 so that the carriage 211 is connected to the liquid ejection head unit 410. Moreover, in the liquid ejection apparatus 1000, a cap 241 and a wiper blade 243 that are used for performing recovery processing of the liquid ejection head 1 are arranged. Furthermore, the liquid ejection apparatus 1000 has a sheet feed unit 215 that stores recording media in a stacked state and an encoder sensor 216 that optically reads a position of the carriage 211.

(Example Liquid Ejection Head Unit)

Figure 1B:
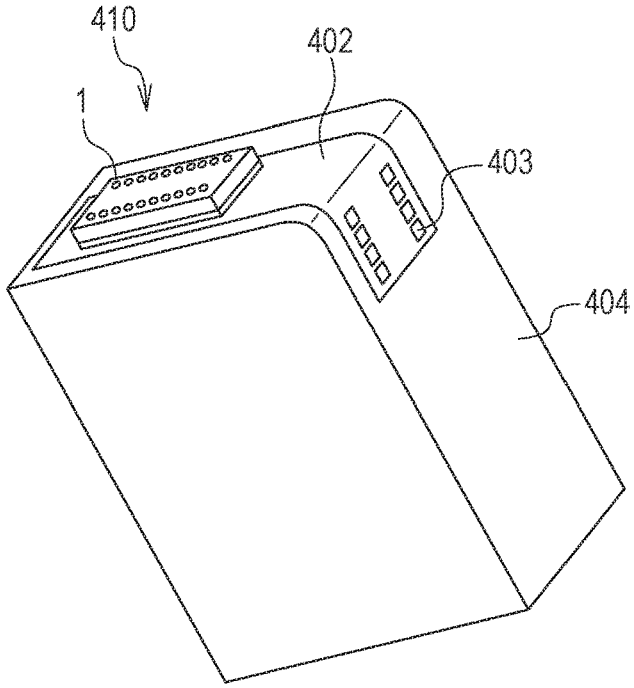

FIG. 1B is a perspective view illustrating the liquid ejection head unit 410. The liquid ejection head unit 410 is a unit in a form of a cartridge in which the liquid ejection head 1 is integrated with a tank. The liquid ejection head unit 410 is configured to be inside the carriage 211 in an attachable and detachable manner. The liquid ejection head 1 is attached to the liquid ejection head unit 410. A tape member 402 for TAB (Tape Automated Bonding) having a terminal that supplies power is bonded to the liquid ejection head unit 410. Through the tape member 402, power is supplied selectively from the liquid ejection apparatus 1000 to each of heat generating resistors 108. In supply of power to the heat generating resistor 108, the power is supplied from a contact 403 to the liquid ejection head 1 through the tape member 402. Furthermore, the liquid ejection head unit 410 includes a tank 404 for temporarily storing liquid and supplying the liquid to the liquid ejection head 1 therefrom.

(Example Liquid Ejection Head)

Figure 2A:
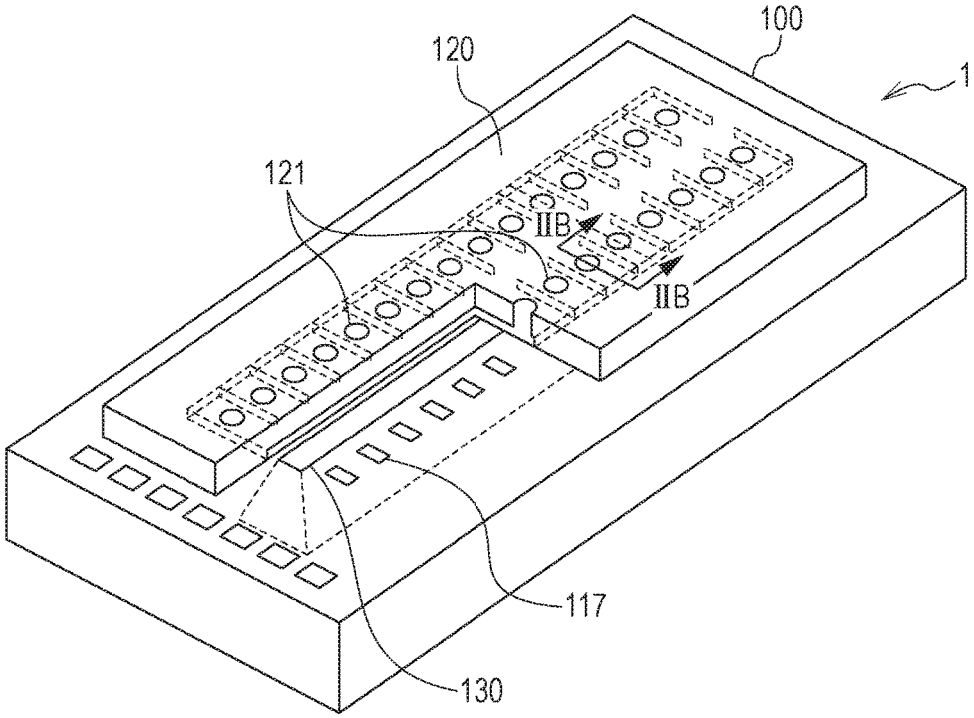
FIGS. 2A and 2B are respectively a perspective view and a sectional view of a liquid ejection head.
Figure 2B:
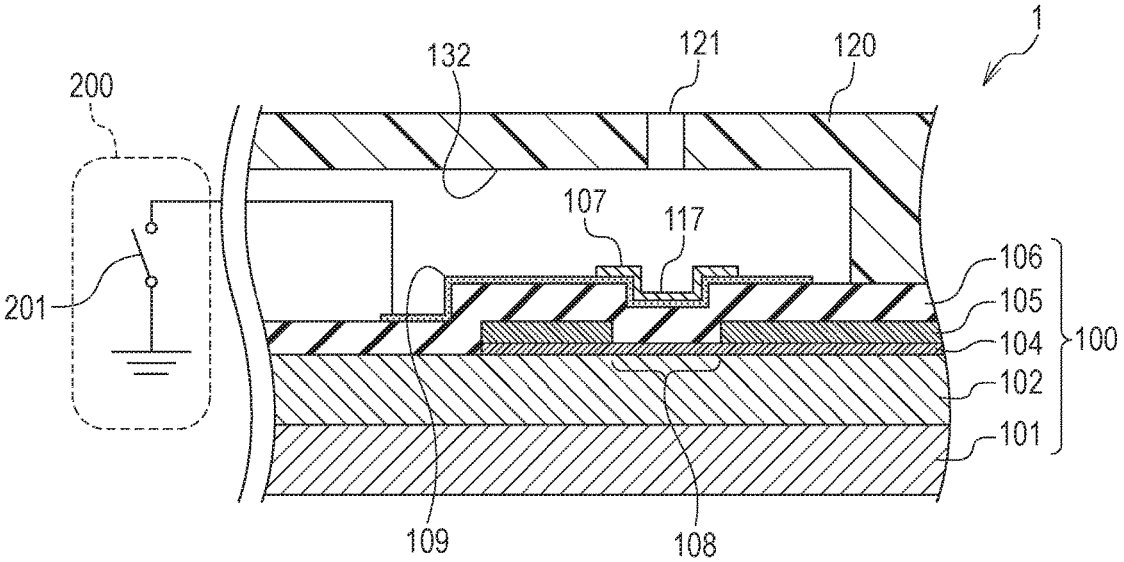

FIG. 2A is a perspective view illustrating the liquid ejection head 1, a part of which is broken away. FIG. 2B is a schematic sectional view taken along a line IIB-IIB in FIG. 2A.

The liquid ejection head 1 is formed by bonding a flow passage forming member 120 to a liquid ejection head substrate 100. A plurality of liquid chambers 132 capable of storing liquid therein are defined between the liquid ejection head substrate 100 and the flow passage forming member 120. A liquid supply port 130 is formed in the liquid ejection head substrate 100 so as to penetrate the liquid ejection head substrate 100 from a front surface to a back surface, and liquid is supplied from the liquid supply port 130 to each of the liquid chambers 132. Heat acting portions 117 are formed in the liquid chambers 132. Ejection ports 121 are formed at positions corresponding to the heat acting portions 117 in the flow passage forming member 120. The plurality of heat acting portions 117 are arranged in a row and the ejection ports 121 provided correspondingly to the heat acting portions 117 are also arranged in a row.

The heat generating resistors 108 described below are provided on a surface of a base 101 of the liquid ejection head substrate 100, in which the heat acting portions 117 are provided, and thermal energy is generated by energizing the heat generating resistors 108. Liquid on the heat acting portions 117 is heated by the thermal energy and bubbles are generated by film boiling, and liquid droplets are ejected from the ejection ports 121 by bubble generating energy generated at that time.

The liquid ejection head 1 has the liquid ejection head substrate 100 in which a plurality of layers are laminated on the base 101 made of silicon. A heat accumulating layer 102 made of a thermal oxide film, a SiO film, a SiN film, or the like is disposed on the base 101. A heat generating resistor layer 104 made of TaSiN or the like is disposed on the heat accumulating layer 102, and an electrode wire layer 105 as a wire made of a metal material such as Al, Al—Si, or Al—Cu is disposed on the heat generating resistor layer 104. An insulating protection layer 106 (insulating layer) is disposed on the electrode wire layer 105. The insulating protection layer 106 is provided above the heat generating resistor layer 104 and the electrode wire layer 105 so as to cover the heat generating resistor layer 104 and the electrode wire layer 105. The insulating protection layer 106 is made of a SiO film, a SiN film, a SiCN film, or the like.

A covering portion 107 is formed above the insulating protection layer 106 so as to cover the heat generating resistor 108. The covering portion 107 protects the heat generating resistor 108 from chemical or physical impact associated with heat generation at the heat generating resistor 108. Covering portions 107 are provided so as to cover the plurality of heat generating resistors 108. In the present embodiment, each of the covering portions 107 is made of a platinum group such as iridium (Ir) or ruthenium (Ru), or tantalum (Ta) with a thickness of 20 to 100 nm. Note that, the material of the covering portion 107 is not limited to any of Ir, Ru, and Ta, and the covering portion 107 may be made of an alloy containing them or may be formed by laminating them. Note that, the covering portion 107 made of such a material has electrical conductivity.

A wire layer 109 by which the plurality of covering portions 107 are electrically connected is provided between the insulating protection layer 106 and the covering portions 107. The wire layer 109 is able to be made of Ta, for example. Note that, a configuration may be such that the wire layer 109 is not provided, that is, a configuration may be such that the covering portions 107 are directly connected to each other.

Each of the heat generating resistors 108 is formed by partially removing the electrode wire layer 105. That is, a part of the electrode wire layer 105 is removed, the heat generating resistor layer 104 is exposed from the part, and a part of the heat generating resistor layer 104, which is exposed from the electrode wire layer 105, functions as the heat generating resistor 108. The electrode wire layer 105 is connected to a drive element circuit or external power source terminal (not illustrated) and configured to be able to receive supply of power from outside.

Note that, the configuration of the heat generating resistor 108 is not limited to the aforementioned configuration in which the electrode wire layer 105 is disposed on the heat generating resistor layer 104. For example, the configuration may be such that the electrode wire layer 105 is formed on the base 101 or the heat accumulating layer 102, the electrode wire layer 105 is partially removed to form a gap, and the heat generating resistor layer 104 is disposed on the electrode wire layer 105. The configuration may be such that the electrode wire layer 105 is embedded in the heat accumulating layer 102 and power is supplied from the electrode wire layer 105 to the heat generating resistor layer 104, which is formed on the heat accumulating layer 102 as a single layer, through a metal plug made of tungsten or the like, for example.

Figure 3:
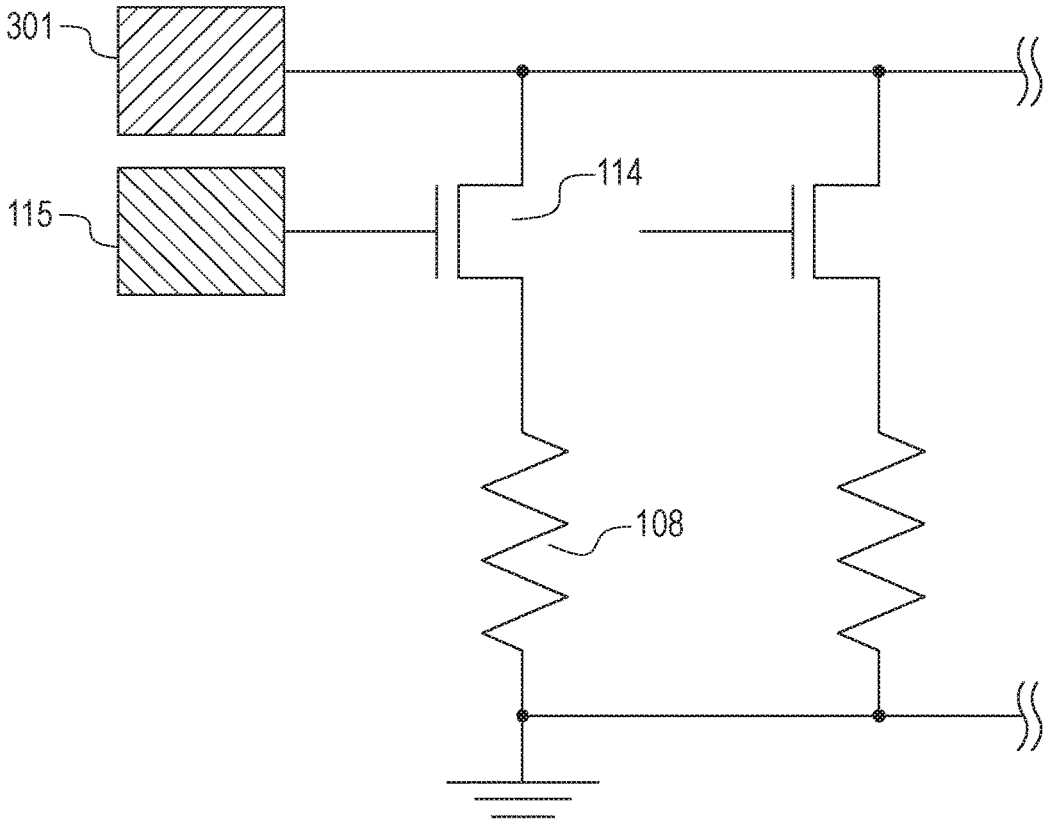
FIG. 3 is an example circuit view of the liquid ejection head.

FIG. 3 illustrates a circuit view for driving the heat generating resistors 108 of the liquid ejection head 1. Each of the heat generating resistors 108 is connected to a power source 301, a switching transistor 114, and a selection circuit 115, and a heat generating resistor 108 selected by the selection circuit 115 is applied with a drive voltage and generates heat. The power source 301 applies the drive voltage of 20 to 35 V, for example. The switching transistor 114 is provided between the power source 301 and the heat generating resistor 108. The liquid ejection head substrate 100 of the present embodiment has such a source follower circuit. Thus, a power source voltage is not always applied to the heat generating resistor 108, but the voltage is applied from the power source 301 to the heat generating resistor 108 in a pulse form only when the heat generating resistor 108 is driven in accordance with an ejection signal.

With such a configuration, power is supplied from the power source 301 to the heat generating resistor 108 at predetermined timing in accordance with the ejection signal from the selection circuit 115, and liquid is ejected from the ejection ports 121 at predetermined timing.

(Example Potential Control Circuit)

Figure 4:
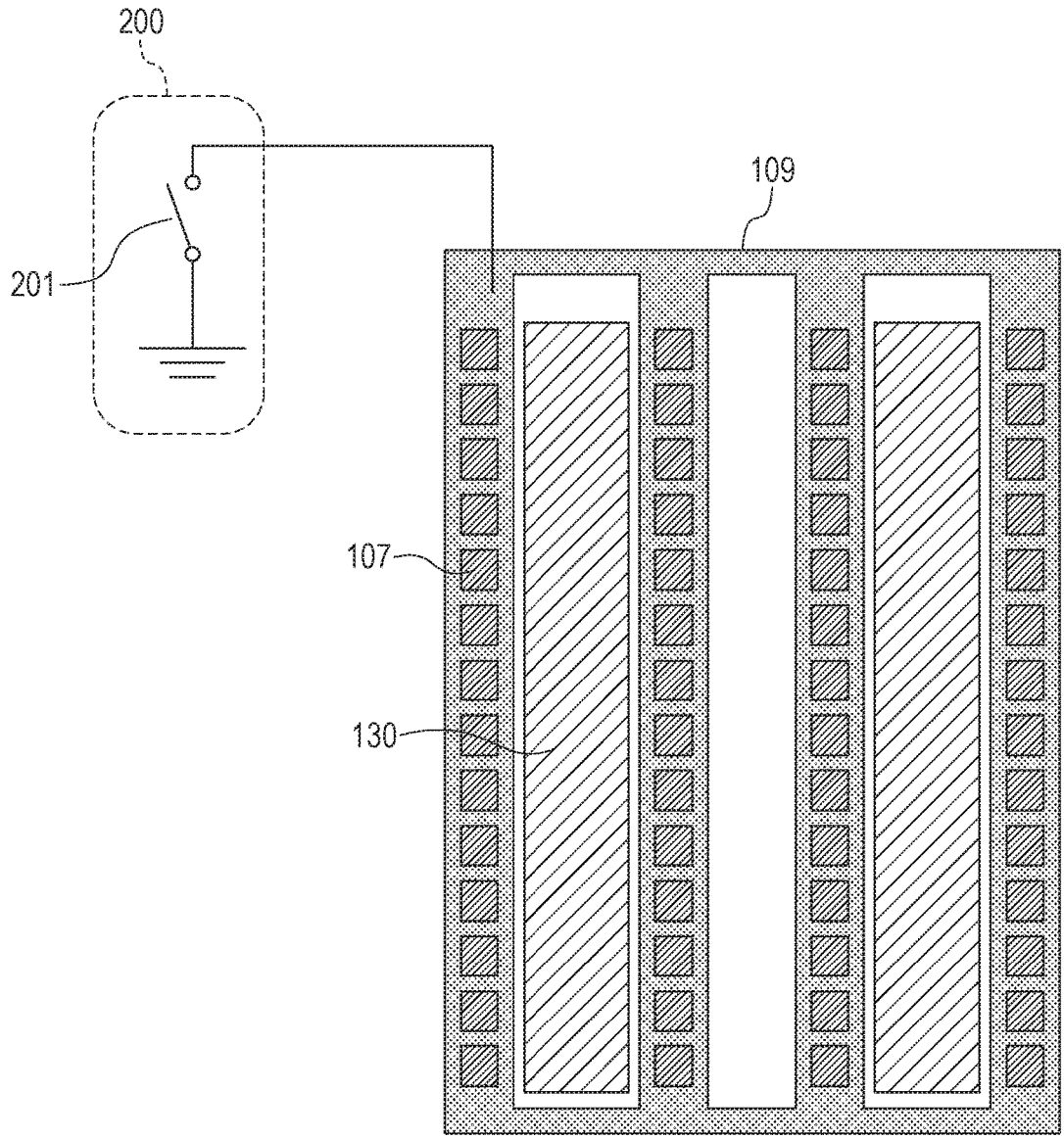
FIG. 4 is a top view of the liquid ejection head.

FIG. 4 is a schematic top view of the liquid ejection head 1 of the present embodiment. Note that, the flow passage forming member 120 is omitted in FIG. 4.

Arrays of the heat generating resistors 108 are arranged on both sides of the liquid supply port 130 and the covering portions 107 that cover the corresponding heat generating resistors 108 are arranged. The wire layer 109 extends in a belt shape and the covering portions 107 are electrically connected through the wire layer 109 to a potential control circuit 200 provided outside the liquid ejection head substrate 100.

The potential control circuit 200 is a circuit (control unit) that controls a surface potential of each of the covering portions 107 and is able to set a potential of the covering portion 107 to a ground potential. The potential control circuit 200 includes a switch 201 and is able to switch control for the surface potential of the covering portion 107 by switching on/off of the switch 201. Note that, the potential control circuit 200 may be provided in a liquid ejection head unit outside the liquid ejection head 1 or in a liquid ejection apparatus main body, or may be provided in the liquid ejection head 1 or the liquid ejection head substrate 100.

While liquid is ejected, electrical connection is caused between the heat generating resistor 108 and the covering portion 107 due to a certain factor and the surface potential of the covering portion 107 increases in some cases.

FIG. 5E2 illustrates a time change of the surface potential of the covering portion 107 in a case where electrical connection is caused between the heat generating resistor 108 and the covering portion 107 in a configuration where the potential control circuit 200 is not provided. Even after the electrical connection is caused between the heat generating resistor 108 and the covering portion 107, a portion where the electrical connection is caused is not specified, and thus a voltage of 24 V with a pulse width of about 0.5 to 2 μsec, for example, is repeatedly applied to the heat generating resistor 108. Therefore, the surface potential of the covering portion 107 is raised to about 5 to 10 V immediately after the pulsed voltage is applied to the heat generating resistor 108. After that, when the voltage is not applied to the heat generating resistor 108, the surface potential of the covering portion 107 is gradually reduced, but particularly in a case where a driving frequency of the heat generating resistor 108 is high, the potential of the covering portion 107 is not fully reduced and the covering portion 107 is kept in a state of being applied with the potential.

Thus, in a case where the covering portion 107 is configured by containing Ir, for example, the covering portion 107 in which the electrical connection with the heat generating resistor 108 is caused brings electrochemical reaction with liquid and elutes in the liquid. Further, in a case where the plurality of covering portions 107 are electrically connected to each other, a covering portion 107 (second covering portion) that covers a heat generating resistor 108 (second heat generating resistor) different from a heat generating resistor 108 (first heat generating resistor) in which electrical connection with a covering portion 107 (first covering portion) is caused may also elute. That is, influence of deterioration of the covering portion 107 may extend to a whole of the liquid ejection head 1.

Note that, also in a case where the covering portion 107 is configured by containing Ta, when the surface potential of the covering portion 107 is kept high, the covering portion 107 in which electrical connection with the heat generating resistor 108 is caused is oxidized. A covering portion 107 that covers a heat generating resistor 108 different from the heat generating resistor 108 in which the electrical connection with the covering portion 107 is caused may be also oxidized.

Then, in the present embodiment, after the drive voltage is applied to at least any of the plurality of heat generating resistors 108, in a state where the drive voltage is not applied to any of the plurality of heat generating resistors 108, the switch 201 of the potential control circuit 200 is tuned on. Thereby, the potential of the covering portion 107 is temporarily set to the ground potential. At this time, the switch 201 of the potential control circuit 200 is turned on in accordance with application of the drive voltage to the heat generating resistor 108 and the potential of the covering portion 107 is periodically set to the ground potential. Note that, here, the plurality of heat generating resistors 108 refer to heat generating resistors 108 whose corresponding covering portions 107 are electrically connected to each other. That is, when the switch 201 of the potential control circuit 200 is tuned on, the heat generating resistors 108 whose corresponding covering portions 107 are not electrically connected may be in a state of being applied with the drive voltage.

In a case where the electrical connection is caused between the heat generating resistor 108 and the covering portion 107, the potential of the covering portion 107 is raised due to the drive voltage of the heat generating resistor 108, but the potential of the covering portion 107 is temporarily reduced to the ground potential by the potential control circuit 200. Thus, it is possible to suppress continuous application of the potential to the covering portion 107. This makes it possible to suppress progress of the electrochemical reaction between the covering portion 107 and liquid and reduce influence of the deterioration of the covering portion 107.

Note that, in a case where the potential of the covering portion 107 is set to the ground potential while the drive voltage is applied to the heat generating resistor 108, when electrical connection is caused between the heat generating resistor 108 and the covering portion 107, leak current flows to the covering portion 107 and the potential control circuit 200 through the portion where the electrical connection is caused. Thereby, there is possibility that heat generation that is not intended is caused and reliability of the liquid ejection head substrate 100 is deteriorated. Thus, in a state where the drive voltage is applied from the power source 301 to at least any of the plurality of heat generating resistors 108 to eject liquid, it is desirable that the switch 201 is turned off and the covering portion 107 is electrically floated.

Note that, the potential control circuit 200 may be configured to set the potential of the covering portion 107 to be lower than the ground potential. When the potential of the covering portion 107 is set to be equal to or less than the ground potential, influence of the deterioration of the covering portion 107 is able to be suppressed.

Note that, in a case where the covering portion 107 is configured by containing Ir, when the potential of 2.5 V or more is continuously applied to the covering portion 107 for a longer time than 35 μsec, dissolution of Ir, which is contained in the covering portion 107, in liquid starts. Thus, it is more desirable that the potential of the covering portion 107 is set to the ground potential so that the surface potential of the covering portion 107 is not kept at 2.5 V or more for a longer time than 35 μsec. That is, it is desirable that the switch 201 of the potential control circuit 200 is turned on to set the potential of the covering portion 107 to the ground potential within 35 μsec after application of the drive voltage to the heat generating resistor 108 starts.

In the present embodiment, whether or not there is a portion where electrical connection between the heat generating resistor 108 and the covering portion 107 is caused, the switch 201 of the potential control circuit 200 is periodically turned on as described above. Thereby, it is not necessary to detect whether or not electrical connection between the heat generating resistor 108 and the covering portion 107 is caused.

Note that, in order to operate the potential control circuit 200 when the drive voltage is not applied to the heat generating resistor 108 as described above, on/off of the switch 201 of the potential control circuit 200 may be switched in synchronization with a signal of the selection circuit 115 (FIG. 3).

Though the potential of the covering portion 107 is set to the ground potential in accordance with application of the drive voltage to the heat generating resistor 108 in the embodiment described above, the switch 201 of the potential control circuit 200 may not be turned on every time after one heat generating resistor 108 is driven once. That is, the influence of the deterioration of the covering portion 107 is able to be reduced also by turning on the switch 201 of the potential control circuit 200 once after applying the drive voltage to one heat generating resistor 108 a plurality of times.

Example 1

The liquid ejection head 1 described below is used as the present example to which the aforementioned embodiment is applied. The liquid ejection head substrate 100 that constitutes the liquid ejection head 1 has the base 101 and the heat accumulating layer 102 that is provided thereon and made of $SiO_2$. Further, the liquid ejection head substrate 100 has the heat generating resistor layer 104 that is made of TaSiN with a thickness of about 50 nm on the heat accumulating layer 102, and the electrode wire layer 105 that is made of an Al wire with a thickness of about 300 nm on the heat generating resistor layer 104. The liquid ejection head substrate 100 also has the heat generating resistor 108 that is formed when a part of the heat generating resistor layer 104 is exposed from a part of the electrode wire layer 105. Further, in the liquid ejection head substrate 100, the insulating protection layer 106 that is made of SiN with a thickness of about 350 nm so as to cover the heat generating resistor layer 104 and the electrode wire layer 105 is disposed, and the covering portion 107 that is made of Ir with a thickness of 100 nm and covers the heat generating resistor 108 is disposed above the insulating protection layer 106. Since the covering portion 107 has low adhesiveness with an ejection port forming member, the covering portion 107 is arranged so as to cover only a region affected by heat by the heat generating resistor 108. The wire layer 109 that is made of Ta with a thickness of 100 nm is provided between the insulating protection layer 106 and the covering portion 107. With the wire layer 109, the plurality of covering portions 107 are electrically connected and each of the covering portions 107 is connected to the potential control circuit 200. The liquid ejection head 1 is constituted in such a manner that the liquid ejection head substrate 100 and the flow passage forming member 120 which is made of a resin material and forms a flow passage with the liquid ejection head substrate 100 are bonded.

In the present example, with use of the liquid ejection head as described above, reliability of the liquid ejection head in a case where electrical connection is caused between the heat generating resistor and the covering portion was verified.

Figure 5A:
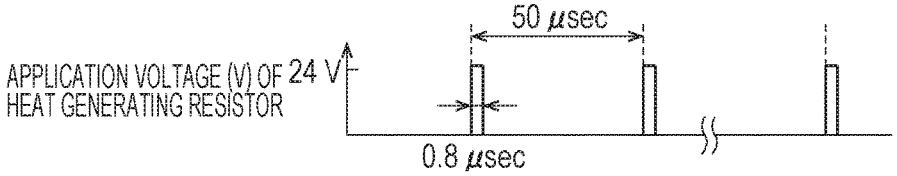
Figure 5A:
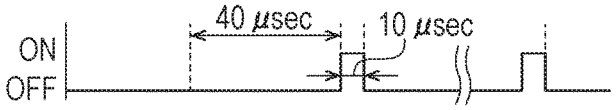
Figure 5A:
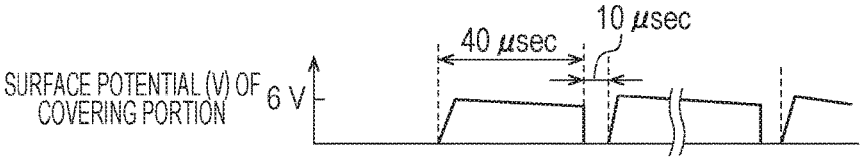
Figure 5A:
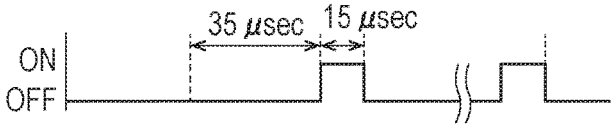
Figure 5A:
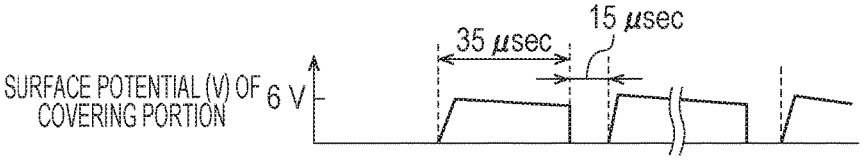
Figure 5A:
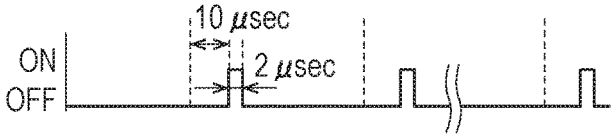
Figure 5A:
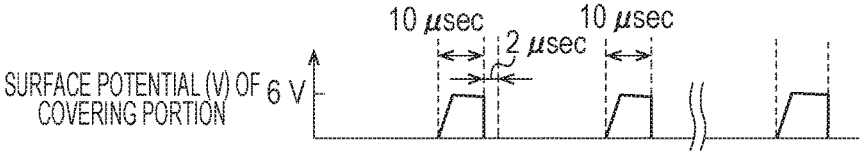
Figure 5A:
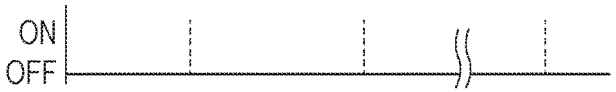
Figure 5A:
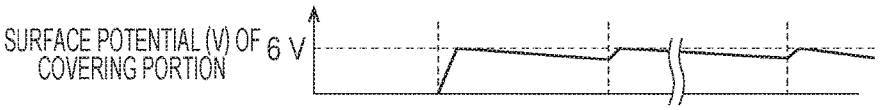
Figure 5A:
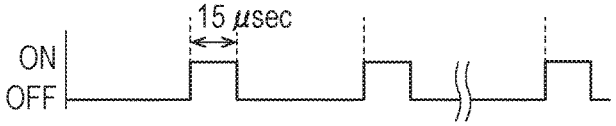
Figure 5A:
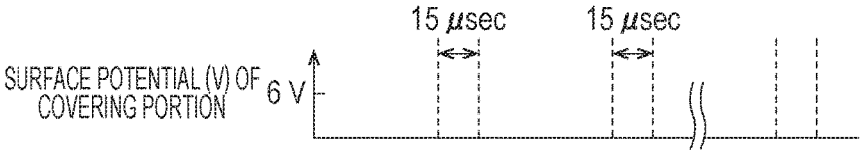

First, a long pulse was applied to one bit of the heat generating resistor of the liquid ejection head to disconnect the heat generating resistor, so that the heat generating resistor was electrically connected to the covering portion. As illustrated in FIG. 5A, a voltage of 24 V and a driving pulse with a pulse width of 0.8 μsec were continuously applied to the one bit of the heat generating resistor, which is disconnected, with a frequency of 20 kHz. That is, the driving pulse was applied to the heat generating resistor per 50 μsec.

Further, as illustrated in FIG. 5B1, the switch of the potential control circuit was turned on in accordance with a driving frequency of the heat generating resistor so that the surface potential of the covering portion was periodically set to the ground potential. Specifically, the driving frequency of the potential control circuit was set to 20 kHz and the pulse width was set to 10 μsec so that the switch of the potential control circuit was turned on 40 μsec later after the application of the drive voltage to the heat generating resistor started.

As a result of checking whether or not a covering portion different from the covering portion for the heat generating resistor that is disconnected elutes in liquid, it was found that some bubbles are generated from a surface of the covering portion, but an elution rate of the covering portion is slower than that of Comparative Example 1 described later. FIG. 5B2 illustrates a time change of the surface potential of the covering portion of the present example.

Example 2

The liquid ejection head described in Example described above was used. In the present example, as illustrated in FIG. 5A, a voltage of 24 V and a driving pulse with a pulse width of 0.8 μsec were continuously applied to the one bit of the heat generating resistor, which is disconnected, with a frequency of 20 kHz. That is, the driving pulse was applied to the heat generating resistor per 50 μsec.

Further, as illustrated in FIG. 5C1, the switch of the potential control circuit was turned on in accordance with the driving frequency of the heat generating resistor so that the surface potential of the covering portion was periodically set to the ground potential. Specifically, the driving frequency of the potential control circuit was set to 20 kHz and the pulse width was set to 15 μsec so that the switch of the potential control circuit was turned on 35 μsec later after the application of the drive voltage to the heat generating resistor started.

As a result of checking whether or not a covering portion different from the covering portion for the heat generating resistor that is disconnected elutes in liquid, it was found that no bubble is generated from a surface of the covering portion and the covering portion does not elute. FIG. 5C2 illustrates a time change of the surface potential of the covering portion of the present example.

Example 3

The liquid ejection head described in Example described above was used. In the present example, as illustrated in FIG. 5A, a voltage of 24 V and a driving pulse with a pulse width of 0.8 μsec were continuously applied to the one bit of the heat generating resistor, which is disconnected, with a frequency of 20 kHz. That is, the driving pulse was applied to the heat generating resistor per 50 μsec.

Further, as illustrated in FIG. 5D1, the switch of the potential control circuit was turned on in accordance with the driving frequency of the heat generating resistor so that the surface potential of the covering portion was periodically set to the ground potential. Specifically, the driving frequency of the potential control circuit was set to 20 kHz and the pulse width was set to 2 μsec so that the switch of the potential control circuit was turned on 10 μsec later after the application of the drive voltage to the heat generating resistor started.

As a result of checking whether or not a covering portion different from the covering portion for the heat generating resistor that is disconnected elutes in liquid, it was found that no bubble is generated from a surface of the covering portion and the covering portion does not elute. FIG. 5D2 illustrates a time change of the surface potential of the covering portion of the present example.

Comparative Example 1

The liquid ejection head described in Example described above was used. In the present comparative example, as illustrated in FIG. 5A, a voltage of 24 V and a driving pulse with a pulse width of 0.8 μsec were continuously applied to the one bit of the heat generating resistor, which is disconnected, with a frequency of 20 kHz. That is, the driving pulse was applied to the heat generating resistor per 50 μsec.

Further, as illustrated in FIG. 5E1, the switch of the potential control circuit was turned off so that the covering portion is electrically floated.

As a result of checking whether or not a covering portion different from the covering portion for the heat generating resistor that is disconnected elutes in liquid, it was found that bubbles are generated from a surface of the covering portion and the covering portion elutes. FIG. 5E2 illustrates a time change of the surface potential of the covering portion of the present comparative example. As the surface potential of the covering portion, the potential of about 6 V was continuously applied.

Comparative Example 2

The liquid ejection head described in Example described above was used. In the present comparative example, as illustrated in FIG. 5A, a voltage of 24 V and a driving pulse with a pulse width of 0.8 μsec were continuously applied to the one bit of the heat generating resistor, which is disconnected, with a frequency of 20 kHz. That is, the driving pulse was applied to the heat generating resistor per 50 μsec.

Further, as illustrated in FIG. 5F1, the switch of the potential control circuit was turned on in accordance with the driving frequency of the heat generating resistor so that the surface potential of the covering portion was periodically set to the ground potential. Specifically, the driving frequency of the potential control circuit was set to 20 kHz and the pulse width was set to 15 μsec so that the switch of the potential control circuit was turned on as the application of the drive voltage to the heat generating resistor started. FIG. 5F2 illustrates a time change of the surface potential of the covering portion of the present comparative example. The surface potential of the covering portion was kept at the ground potential.

As a result of checking whether or not a covering portion different from the covering portion for the heat generating resistor that is disconnected elutes in liquid, it was found that no bubble is generated from a surface of the covering portion and the covering portion does not elute. However, leak current flowed to the potential control circuit from the heat generating resistor.

A table 1 collectively indicates Examples and Comparative Examples described above.

It was confirmed that the elution rate of the covering portion (Ir) is reduced when the potential control circuit is driven to periodically set the surface potential of the covering portion to the ground potential. It was also found that when the surface potential of the covering portion is kept at 2.5 V or more for a longer time than 35 μsec, dissolution of Ir, which is contained in the covering portion, in liquid starts. Thus, it was found that it is more desirable that the potential of the covering portion is set to the ground potential so that the surface potential of the covering portion is not kept at 2.5 V or more for a longer time than 35 μsec. That is, it was found that it is desirable that the switch of the potential control circuit 200 is turned on to set the potential of the covering portion 107 to the ground potential within 35 μsec after the application of the drive voltage to the heat generating resistor starts.

TABLE 1

| | Driving of potential control circuit | | | |
|---|---|---|---|---|
| | Pulse width (time of state where switch is turned on) | Time until switch is turned on after driving of heat generating resistor starts | Elution of covering portion | Leak to potential control circuit |
| Example 1 | 10 μsec | 40 μsec | Slightly eluted | Not leaked |
| Example 2 | 15 μsec | 35 μsec | Not eluted | Not leaked |
| Example 3 | 2 μsec | 10 μsec | Not eluted | Not leaked |

TABLE 1-continued

| | Driving of potential control circuit | | | |
|---|---|---|---|---|
| | Pulse width (time of state where switch is turned on) | Time until switch is turned on after driving of heat generating resistor starts | Elution of covering portion | Leak to potential control circuit |
| Comparative Example 1 | 0 μsec | — | Eluted | Not leaked |
| Comparative Example 2 | 15 μsec | 0 μsec | Not eluted | Leaked |

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-141121 filed Jul. 20, 2017, which is hereby incorporated by reference herein in its entirety.

What is claimed is:

1. A control method of a liquid ejection head, the liquid ejection head including:

a first heat generating resistor and a second heat generating resistor that generate thermal energy for ejecting liquid through application of a drive voltage;

a first covering portion that covers the first heat generating resistor;

a second covering portion that is electrically connected to the first covering portion and covers the second heat generating resistor; and an insulating layer that is provided between the first heat generating resistor and the first covering portion and between the second heat generating resistor and the second covering portion, the method comprising:

setting surface potentials of the first covering portion and the second covering portion to be equal to or less than a ground potential in a state where the drive voltage is not applied to the first heat generating resistor and the second heat generating resistor, in accordance with application of the drive voltage to at least either the first heat generating resistor or the second heat generating resistor.

2. The control method of the liquid ejection head according to claim 1, wherein in a state where the drive voltage is applied to at least either the first heat generating resistor or the second heat generating resistor, the first covering portion and the second covering portion are electrically floated.

3. The control method of the liquid ejection head according to claim 1, wherein the surface potentials of the first covering portion and the second covering portion are periodically set to be equal to or less than the ground potential.

4. The control method of the liquid ejection head according to claim 1, wherein the first covering portion and the second covering portion contain Ir, and wherein the surface potentials of the first covering portion and the second covering portion are set to be equal to or less than the ground potential within 35 μsec after application of the drive voltage to at least either the first heat generating resistor or the second heat generating resistor starts.

5. The control method of the liquid ejection head according to claim 1, wherein the drive voltage is applied to the first heat generating resistor and the second heat generating resistor in a pulse form in accordance with an ejection signal.

6. A liquid ejection apparatus comprising:

a liquid ejection head that includes a first heat generating resistor and a second heat generating resistor that generate thermal energy for ejecting liquid through application of a drive voltage, a first covering portion that covers the first heat generating resistor, a second covering portion that is electrically connected to the first covering portion and covers the second heat generating resistor, and an insulating layer that is provided between the first heat generating resistor and the first covering portion and between the second heat generating resistor and the second covering portion; and a control unit configured to control surface potentials of the first covering portion and the second covering portion, wherein the control unit includes a switch that sets the surface potentials of the first covering portion and the second covering portion to be equal to or less than a ground potential in a state where the drive voltage is not applied to the first heat generating resistor and the second heat generating resistor, in accordance with application of the drive voltage to at least either the first heat generating resistor or the second heat generating resistor.

7. The liquid ejection apparatus according to claim 6, wherein in a state where the drive voltage is applied to at least either the first heat generating resistor or the second heat generating resistor, the control unit causes the first covering portion and the second covering portion to be electrically floated.

8. The liquid ejection apparatus according to claim 6, wherein the control unit periodically sets the surface potentials of the first covering portion and the second covering portion to be equal to or less than the ground potential.

9. The liquid ejection apparatus according to claim 6, wherein the first covering portion and the second covering portion contain Ir, and the control unit sets the surface potentials of the first covering portion and the second covering portion to be equal to or less than the ground potential within 35 μsec after application of the drive voltage to at least either the first heat generating resistor or the second heat generating resistor starts.

10. The liquid ejection apparatus according to claim 6, wherein the drive voltage is applied to the first heat generating resistor and the second heat generating resistor in a pulse form in accordance with an ejection signal.

* * * * *